United States Patent [19]

Gentry

[11] 4,437,901

[45] Mar. 20, 1984

[54] METHOD AND APPARATUS FOR IMPROVED HEAT TREATMENT OF ALUMINUM ALLOY ROD

[75] Inventor: Bobby C. Gentry, Temple, Ga.

[73] Assignee: Southwire Company, Ga.

[21] Appl. No.: 332,988

[22] Filed: Dec. 21, 1981

[51] Int. Cl.[3] ..... C21D 1/00; C21D 9/62

[52] U.S. Cl. ..... 148/11.5 A; 148/159; 148/415; 266/103; 266/104

[58] Field of Search ..... 148/11.5 A, 12 B, 154, 148/158, 159; 266/103, 104, 112, 110, 111, 106, 107, 108, 109, 102

[56] References Cited

U.S. PATENT DOCUMENTS

| | | | |
|---|---|---|---|
| 1,607,675 | 11/1926 | Jefferies | 219/10.61 R |
| 2,203,946 | 6/1940 | Doescher | 266/110 |
| 2,887,422 | 5/1959 | Stone et al. | 148/159 |
| 2,965,368 | 12/1960 | McIlvried | 266/110 |
| 3,194,545 | 7/1959 | Smith | 148/159 |
| 3,312,576 | 4/1967 | Palik | 148/11.5 A |
| 3,418,177 | 12/1968 | Pryor | 148/11.5 A |
| 3,486,947 | 12/1969 | Pryor et al. | 148/11.5 A |
| 4,151,896 | 5/1979 | Nicoud et al. | 148/11.5 A |
| 4,177,085 | 12/1979 | Chadwick et al. | 148/11.5 A |
| 4,249,720 | 2/1981 | Weyand et al. | 148/154 |

OTHER PUBLICATIONS

Sublett, I "Thermal Treatment Pertaining to Aluminum Production" *Wire and Wire Products* vol. 40, No. 11, 11/65, pp. 1766–1769; 1801–1803.

Sublett, II"Thermal Treatment of Aluminum Wire for Mechanical Applications," *Wire Technology*, 11/27/77, pp. 45–49.

*Primary Examiner*—L. Dewayne Rutledge

*Assistant Examiner*—S. Kastler

*Attorney, Agent, or Firm*—Herbert M. Hanegan; Stanley L. Tate; Robert S. Linne

[57] ABSTRACT

Solution heat treatment of a rapidly advancing intermediate metallic product (26) is accomplished by preheating the product in a first zone (27) by conventional means, a great length of the product is maintained at the desired temperature in a second zone (36), and the heated product is quenched in a third zone (40) in a special apparatus (25), before further processing.

13 Claims, 2 Drawing Figures

METHOD AND APPARATUS FOR IMPROVED HEAT TREATMENT OF ALUMINUM ALLOY ROD

TECHNICAL FIELD

The present invention relates to the metallurgical arts, and more specifically to an improved method and apparatus for continuously heat treating aluminum alloy rod or the like following working of the cast bar or billet.

BACKGROUND OF THE INVENTION

Improved aluminum alloy electrical conductors were developed and improved throughout the 1970's including so-called "Al—Mg—Si" alloys and alloy 6201 for overhead conductors among many others. The especially useful properties of the various alloy conductors are generally achieved through combinations of working the metal and thermal treatments. It is to the latter manufacturing operation that this invention is directed.

Of the various thermal treatment by which the alloy rod or wire properties are achieved, this invention is most useful in solution heat treating (or solutionizing), homogenization, annealing, and precipitation treating (or aging).

Generally, the term "solution heat treating" is applied when an alloy is heated at a given temperature for a given time in order to allow soluble constituents to enter into solid solution, where they are retained in a supersaturated state after quenching. The "Al—Mg—Si" and 6201 alloys are such. A solution heat treated aluminum alloy, suitably solutionized and quenched and with subsequent treatments, can provide high mechanical properties such as tensile strengths greater than 46,000 lbs/in$^2$.

Homogenization is a high temperature soaking treatment to eliminate or reduce segregation by diffusion, obtaining thereby a uniform structure and an even distribution of alloying constituents; it has been described as particularly applicable for those aluminum alloys having up to 12% alloying constituents. Often, homogenization consists of heating to near the eutectic melting point and maintaining this temperature for up to several hours. A stronger, more ductile (and homogeneous) structure may result if homogenization is properly performed.

Annealing is the heating of the alloy to about the recrystallization temperature and maintaining the desired temperature for a particular desired period of time, after which the alloy is cooled or quenched. Annealing is often used to soften metal by removal of stress resulting from cold working or by coalescing precipitates from solid solution.

Precipitation treating, or aging, is of two types, natural (usually at room temperature) or artificial (usually at elevated temperatures). Aging gives certain alloys maximum strength and may be performed in coordination with certain solution heat treatment procedures. Aging comprises the prcipitation of small particles from solid solution under controlled temperatures.

Various aluminum products are used as electrical conductors, including EC (electrical conductor grade) and various alloys including Triple E®, Super T®, NiCo®, the Aluminum Association 1350, 5005, 6101, 6201 and others. Electrical conductivity standards from about 50 percent of IACS (International Annealed Copper Standard) to about 62% of IACS are common, depending on the alloy and use intended. Certain alloys, for example the aluminum conductor alloy 6201 require careful preparation to achieve their most desirable properties. Ordinarily, aluminum alloys may be manufactured continuously and certain production economies associated therewith are obtained; see U.S. Pat. No. 3,613,767.

In producing many of these aluminum alloys, a continuous casting machine serves as a means to solidify the molten aluminum alloy metal into a cast bar product which is subsequently hot-formed into an elongated rod or other intermediate product. The hot forming may be used to impart substantial movement to the cast bar along a plurality of angularly disposed axes. For illustration but not limitation, the casting machine may be of the wheel/band type including a casting wheel having in the periphery thereof a groove partially closed by an endless band. The wheel and band cooperate to provide a mold, into one end of which molten metal is poured to solidify, and from the other end of which the cast bar is emitted in substantially that condition in which it was solidified. The cast bar is often conveyed directly into a rolling mill, but may in certain cases be subjected to a preliminary heat treatment.

The rolling mill is of a conventional type having a plurality of roll stands arranged to hot-form the cast bar by a series of deformations. By rolling the cast bar substantially immediately upon extraction from the casting machine, the cast bar remains at a hot-forming temperature within a range of hot-forming temperatures. The cast bar may, however be adjusted by thermal treatment, as desired, by appropriate apparatus. The rolling mill reduces the bar cross section and elongates it to produce a rod product having a smaller cross section.

Rolled alloy rod such as is produced according to the foregoing it may undergo certain heat treatments such as solutionizing before being processed in a reduction operation designed to produce continuous lengths of wire having various diameters, such as by drawing operations. Such drawing includes passing the rolled rod product through a successive series of progressively constricted dies to form the wire of desired diameter. Alternatively, the rod may be rolled down to smaller (wire) diameters. At the conclusion of the cross section reduction process, and intermediately during the process with certain alloys, the wire product may be subjected to one of the foregoing thermal treatments to achieve a desired combination of as-drawn properties. With certain alloy conductor materials the unannealed rod (F temper) may be cold drawn without intermediate anneals, resulting generally in a wire product having very high tensile strength, and low conductivity and/or ultimate elongation properties.

Thence may follow one or more thermal treatments in the ordinary course of manufacturing operations. In the production of many electrical conductor alloys, the final thermal treatments given are annealing or aging.

It is often necessary for coils of rod or intermediate product to be transported between rolling and drawing, or may otherwise incur delays between rolling and drawing. In other cases, it may be desirable to solution heat treat rod in order to achieve desirable characteristics or combinations of characteristics. Ordinarily, such thermal treatment is accomplished in batches rather than continuously, resulting in length limitations between welds (which cause locallized disruptions in characteristics), or often, uneven thermal treatment of the rod due to package configurations or nonuniform soak/cool times.

DISCLOSURE OF INVENTION

The present invention solves these and other problems by the use of a special device to increase the duration of the thermal treatment applied to the continuously advancing rolled rod and/or the added process step of holding the continuously advancing rod at a selected elevated temperature for a selected time to ensure that the desired mechanical and electrical properties are achieved in the rod product. With most electrical conductor grade alloys there is a range of temperature/time relationships during which a given size rod of the particular alloy will reach the desired characteristics. With, for example, AlMgSi alloys such as 6201 series, the rod may receive a solutionizing heat treatment step at some time after being rolled down to rod and before final cross section reduction and working, as by drawing or micro-rolling. Alloy 6201 may, for example, be heated to within a range of 800 to 1000 degrees F. and then held at that temperature for about 30 seconds to 5 minutes before being quenched in water, then it may be conveyed to a drawing operation, followed by annealing or other thermal treatment.

BEST MODE FOR CARRYING OUT THE INVENTION

Figure 1:
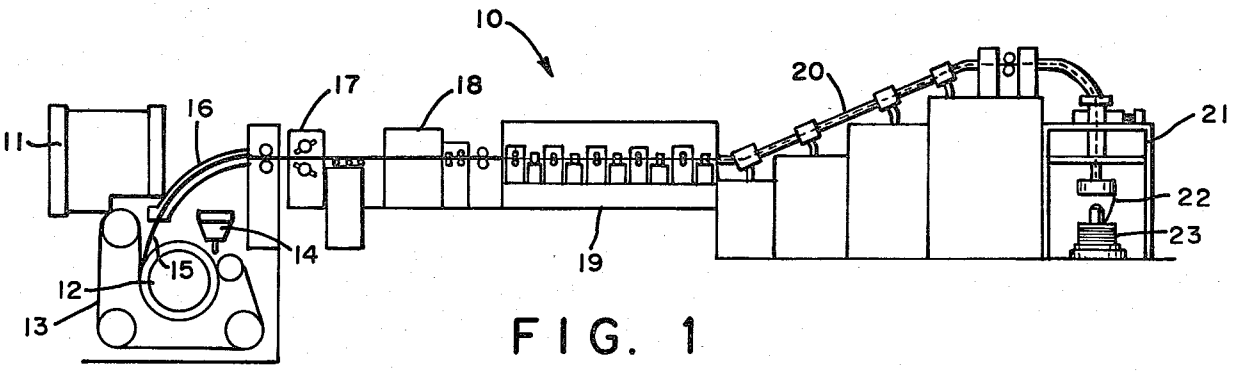
FIG. 1 is a simplified diagram of an exemplary system for continuous casting and rolling of molten metals, which may include heat treatments of the solidified metal at various stages in the production process (not shown).

Referring to FIG. 1, a continuous casting and rolling apparatus 10 is shown, in which molten metal is supplied to pour pot 14 by melting/holding furnace 11, poured into a mold formed by a peripheral groove in a rotating casting wheel 12 and casting band 13. Coolant (not shown) is applied to the closed portion of the mold to solidify the molten metal, forming a cast bar 15, which is guided by cast bar conveyor 16 away from the casting machine to subsequent operations. Shear 17 may be used to sever sections of the cast bar 15, as may be required during ordinary manufacturing operations. The cast bar 15 is routed through prerolling station 18 which may contain an initial bar heat treatment apparatus (not shown) and is then directed into the rolling mill 19, in which a plurality of roll stations work the metal, reducing its cross section and elongating it. Delivery pipe 20, in which certain thermal treatments may be performed, guides the thus-formed continuous cast and rolled rod product to a coiler station 21, where the rod 22 is collected into coils 23 for convenient handling, and storage or shipping.

It is at this point when a solutionizing heat treatment is given the rod according to the present invention.

Figure 2:
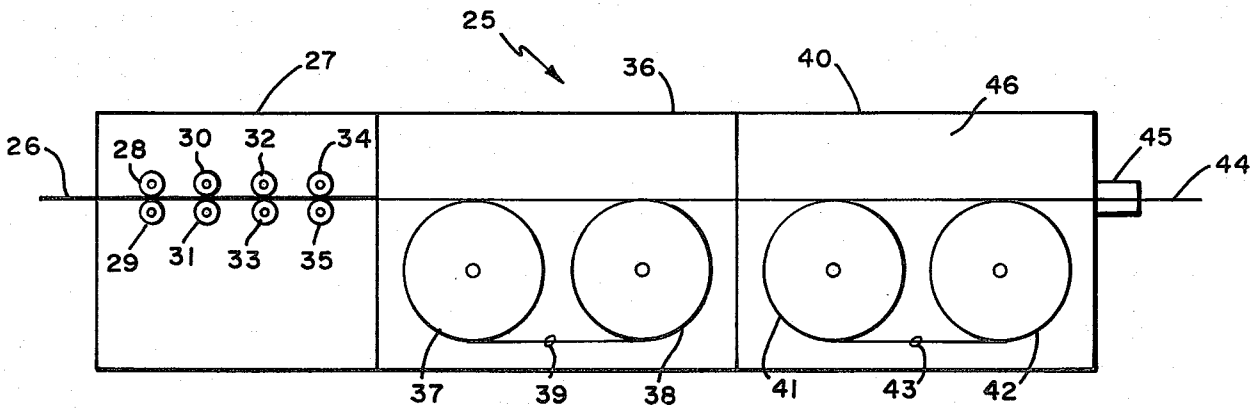
FIG. 2 is a simplified drawing exhibiting apparatus representative of the present invention, including an initial rod heating step, rod heat holding chamber, and rod quench chamber.

Referring now to FIG. 2, a thermal treatment apparatus 25 for rod, wire, or other intermediate product is shown, in which an untreated rod 26 enters a first zone of heat treatment, for example but not limitation a chamber 27 enclosing a contact-type resistance annealer formed by a plurality of paired contact rollers having alternately electrically charged contact rolls 28, 29, 30, 31, 32, 33, 34, 35. The rod 26 is passed through an aperture (not shown) in the first chamber 27 and through a similar aperture in a second chamber 36. The rod 26 is directed around a first pair of drums 37, 38 in a plurality of wraps 39 and maintained at an elevated temperature by temperature controlled heating means (not shown) contained in the second chamber 36. It will be understood that a number of heat sources may be used for this purpose, including heated fluids including but not limited to a molten salt bath, radiant heaters, or heat created by passing an electrical current through the rod by placing electrical charges on the drums 37, 38. Second chamber 36 may be insulated to minimize heat energy loss, as appropriate. Third chamber 40 is a controlled cool-down or quench chamber; the cooling therein may be accomplished, for example, by flowing a temperature controlled coolant 46 therethrough at a rate sufficient to reduce the rod 26 temperature at the desired rate. The rod 26 is passed out of second chamber 36 and into third chamber 40 through a suitable seal means (not shown). In third chamber 40 the rod 26 is directed around a second pair of drums 41, 42 in a plurality of wraps 43 and passed out of the third (cooling) chamber 40, as fully heat treated rod 44, to further process operations through an air wipe seal to prevent carrying any coolant away.

The rod is then usually further reduced in cross section and lengthened into a smaller elongated product such as wire, as by drawing it in a conventional drawing machine or rolling in a conventional micro-mill. The metal may be subjected to various intermediate thermal treatments while being reduced in cross section.

For the purposes of this invention, the term intermediate rod may be defined as a finished redraw product produced by the rolling mill, or a smaller diameter product produced by either rolling or drawing the rolling mill product in a subsequent step or operation.

INDUSTRIAL APPLICABILITY

The present invention is most useful in replacing or adapting existing thermal treatment apparatus for high speed, continuous rod use wherein the thermal treatment accorded an aluminum or aluminum alloy rod may be carefully regulated to optimize the electrical and mechanical properties of the wire.

It is also useful in re-solutionizing rod that has partially or fully precipitated the alloying constituents by natural aging occurring from extensive time duration between the rolling and reduction processes.

I claim:

1. Thermal treatment apparatus adapted for use with an elongated metallic rod product comprising:

(a) a first heat treatment zone for elevating the temperature of an elongated metallic rod product to a first elevated temperature by means of electrical resistance heating thereof, said rod following a predetermined path through said zone, (b) second heat treatment zone having means therein for maintaining the elevated temperature of a first extended length of the elongated metallic rod product at said first elevated temperature, and in which the rod is heated by thermostatically controlled electric radiant heating and is multiply wrapped only partially around pair of rotatable cylinders within the second heat treatment zone; said cylinders having parallel axes in a horizontal plane, (c) a third heat treatment zone having means therein for controlled cooling of a second extended length of elongated metallic rod product in which the rod is multiply wrapped only partially around a pair of rotatable cylinders within the third heat treatment zone, said cylinders having parallel axes in a horizontal plane, and wherein the elongated metallic rod product is continuously and sequentially advanced through said first zone, said second zone, and third zone.

2. Intermediate rod product thermal treatment apparatus as in claim 1, wherein said means for controlled cooling of the second extended length of elongated metallic material comprises a fluid in said third zone.

3. Intermediate rod product thermal treatment apparatus as in claim 1, wherein said means for maintaining the temperature of the first extended length of elongated metallic material comprises a heated fluid passing through said second zone.

4. Apparatus as in claims 2 or 3, wherein said fluid is a gas.

5. Apparatus as in claims 2 or 3, wherein said fluid is a liquid.

6. Apparatus as in claims 2 or 3, wherein said fluid is a molten salt bath.

7. A method for the thermal treatment of an intermediate metallic rod product comprising the steps of:

(a) continuously advancing an elongated metallic rod product along a predetermined path, (b) passing an electrical current through said elongated rod product to elevate the temperature thereof to a predetermined solution heat treating temperature in a first heating zone, (c) continuously advancing the elongated metallic rod product through a second heating zone and heating the rod product therein by thermostatically controlled radiant heaters and accumulating an extended length of the metallic rod product therein in multiple wraps only partially around a pair of rotatable cylinders within the second heating zone and having parallel axes in a horizontal plane, (d) maintaining the continuously advancing elongated metallic rod product within the second heating zone until solutionizing is completed, (e) continuously advancing the elongated metallic rod product through a cooling zone, and (f) cooling the continuously advancing elongated metallic rod product to room temperature after solutionizing is completed.

8. A method for the thermal treatment of an intermediate metallic rod product comprising the steps of:

(a) continuously advancing an elongated metallic rod product along a predetermined path, (b) passing an electrical current through said elongated rod product to elevate the temperature thereof to a predetermined solution heat treating temperature in a first heating zone, (c) continuously advancing the elongated metallic rod product through a second heating zone and heating the rod product therein by contacting the rod product with a heated fluid and accumulating an extended length of the elongated metallic rod product therein in multiple wraps only partially around a pair of rotatable cylinders within the second heating zone and having parallel axes in a horizontal plane, (d) maintaining the continuously advancing elongated metallic rod product within the second heating zone until solutionizing is completed, (e) continuously advancing the elongated metallic rod product through a cooling zone, and (f) cooling the continuously advancing elongated metallic rod product to room temperature after solutionizing is completed.

9. A method of thermal treatment of an intermediate rod product according to claim 7, further including the step of accumulating an extended length of elongated metallic material in the cooling zone.

10. A method of thermal treatment of an intermediate rod product according to claim 7, wherein the temperature of the cooling zone in step d is controlled so as to reduce the rod product temperature from the solutionizing temperature of the metal to a temperature at which no substantial immediate precipitation occurs within a time interval before which any substantial precipitation occurs.

11. A method according to claim 8, wherein the fluid is a gas.

12. A method according to claim 8, wherein the fluid is a liquid.

13. A method according to claim 8, wherein the fluid is a molten salt bath.

* * * * *